US005182035A

United States Patent [19]

Schmidt et al.

[11] Patent Number: 5,182,035

[45] Date of Patent: Jan. 26, 1993

[54] ANTIMICROBIAL LUBRICANT COMPOSITION CONTAINING A DIAMINE ACETATE

[75] Inventors: Bruce E. Schmidt, St. Paul, Minn.; Robert E. F. Swerts, Limburg, Belgium

[73] Assignee: Ecolab Inc., St. Paul, Minn.

[21] Appl. No.: 642,057

[22] Filed: Jan. 16, 1991

[51] Int. Cl.[5] ..... C10M 133/02; C10M 173/02

[52] U.S. Cl. ..... 252/34; 252/49.3; 252/52 R

[58] Field of Search ..... 252/34, 99.3, 49.3

[56] References Cited

U.S. PATENT DOCUMENTS

| | | | |
|---|---|---|---|
| Re. 30,885 | 3/1982 | Rieder . | |
| 3,148,747 | 9/1964 | Batchelor . | |
| 3,170,539 | 2/1965 | Snay et al. . | |
| 3,336,225 | 8/1967 | Sayad et al. . | |
| 3,576,234 | 4/1971 | Batchelor . | |
| 3,583,914 | 6/1971 | Garvin et al. | 252/34.7 |
| 3,766,068 | 10/1973 | Tesdahl et al. . | |
| 3,860,521 | 1/1975 | Aepli et al. . | |
| 4,226,325 | 10/1980 | Vandas . | |
| 4,511,482 | 4/1985 | Horodysky . | |
| 4,552,569 | 11/1985 | Horodysky . | |
| 4,566,879 | 1/1986 | Horodysky . | |
| 4,581,039 | 4/1986 | Horodysky . | |
| 4,589,992 | 5/1986 | Phillips et al. | 252/34 |
| 4,613,343 | 9/1986 | Horodysky . | |
| 4,626,367 | 12/1986 | Kuwamoto et al. . | |
| 4,789,493 | 12/1988 | Horodysky . | |
| 4,828,735 | 5/1989 | Minagawa et al. . | |
| 4,839,067 | 6/1989 | Jansen | 252/11 |
| 4,848,119 | 7/1989 | Horodysky . | |
| 4,895,668 | 1/1990 | Singh et al. | 252/34 |
| 4,929,375 | 5/1990 | Rossio et al. | 252/49.3 |
| 5,062,978 | 11/1991 | Weber et al. | 252/49.3 |

FOREIGN PATENT DOCUMENTS

| | | |
|---|---|---|
| 50919/90 | 5/1990 | Australia . |
| 70188/91 | 3/1991 | Australia . |
| 0044458 | 1/1982 | European Pat. Off. . |
| 0233774 | 8/1987 | European Pat. Off. . |
| 0372628 | 6/1990 | European Pat. Off. . |
| 0384282 | 8/1990 | European Pat. Off. . |
| 0445525 A1 | 9/1991 | European Pat. Off. . |
| 2-55794 | 2/1974 | Japan . |
| 90/10053 | 9/1990 | PCT Int'l Appl. . |

OTHER PUBLICATIONS

*The Merck Index*, Eleventh Edition, 1989, p. 2095.

*Disinfection, Sterilization, and Preservation*, Fourth Edition, Seymour S. Block, 1991, pp. 228, 248, 249, 274, 275.

*Inhibition and Destruction of the Microbial Cell*, Ed. W. B. Hugo, pp. 636–639, 675 and 685.

*Recent Developments in the Technology of Surfactants*, Critical reports on applied Chemistry, vol. 30, 1990, pp. 65–73.

*Chlorhexidine*, Chapter 16, G. W. Denton, pp. 274–275.

Akzo Chemie America Bulletin 85-1, Specifications and Properties of DUOMEEN® Diamines and Diamine Salts DUOMAC® Diamine Acetate Salts, pp. 1–6.

*Primary Examiner*—Ellen McAvoy

*Attorney, Agent, or Firm*—Merchant, Gould, Smith, Edell, Welter & Schmidt

[57] ABSTRACT

Concentrated solid and liquid antimicrobial lubricating compositions which include (−) about 1–20 wt % of a diamine acetate salt having the formula $[(R^1)NH(R^2)NH_3]^+(CH_3COO)^-$ $[(R^1)NH_2(R^2)NH_3{+}{+}](CH_3COO)_2^-$ wherein $R^1$ is a $C_{10-18}$ aliphatic group or an ether group having the formula $R^{10}O(R^{11})$ wherein $R^{10}$ is a $C_{10-18}$ aliphatic group and $R^{11}$ is a $C_{1-5}$ alkyl group; and $R^2$ is a $C_{1-5}$ alkylene group, (−) about 0–30 wt % of an alcohol for the purpose of enhancing the physical stability of the composition, and (−) about 0–20 wt % of a nonionic surfactant. The liquid form of the lubricant composition includes a major proportion of water while the solid form of the lubricant composition includes an amount of a solidification agent effective for assisting in solidification of the composition. The lubricating compositions are particularly useful on the load bearing surfaces of conveyor belts used in food preparation where a combination of effective lubricity and efficacious antimicrobial activity are necessary.

16 Claims, No Drawings

ANTIMICROBIAL LUBRICANT COMPOSITION CONTAINING A DIAMINE ACETATE

FIELD OF THE INVENTION

The invention relates to lubricant compositions and more particularly to antimicrobial lubricant compositions adapted for use as a lubricating and antimicrobial agent on the load bearing surfaces of a chain driven conveyor system.

BACKGROUND OF THE INVENTION

Beverages and other comestibles are often processed and packaged on mechanized conveyor systems which are lubricated to reduce friction between the packaging and the load bearing surface of the conveyor. The lubricants commonly used on the load bearing surfaces of these conveyor systems, such as those used in the food processing, beverage and the brewery industries, typically contain fatty acid soaps as the active lubricating ingredient because of the superior lubricity provided by fatty acid soaps.

In addition to lubricants, conveyor systems used in the processing and packaging of comestibles are also commonly treated with an antimicrobial agent, particularly the moving portions of the conveyor system likely to carry residue of a food substance, such as the load bearing surface, in order to reduce the population of microorganisms, such as bacteria, yeast and mold, which tend to grow on the system and produce slime. Unfortunately, those antimicrobial agents found to be particularly effective for controlling microbiological populations on a conveyor system are difficult to combine with fatty acid soaps because many of these antimicrobial agents are deactivated by the anionic fatty acids.

Fatty acid soaps are known to form insoluble precipitates in the presence of cations responsible for the property of water known as hardness ($Ca^{++}$, $Mg^{++}$). This property of fatty acid soaps requires that water softeners and/or chemical chelating agents such as EDTA be used with lubricants based on fatty acid soaps to prevent formation of a precipitate. Failure to implement such measures generally results in the formation of a precipitate which quickly plugs the spray nozzles used for applying the lubricant to the conveyor.

Fatty acid free lubricant compositions have been developed in an effort to avoid or eliminate the precipitation problem encountered when the lubricant is diluted with water containing hardness ions. For example, Jansen, U.S. Pat. No. 4,839,067 discloses a process for the maintenance of chain-type conveyor belts by treating the conveyor belt with a lubricant composition containing a lubricating amount of a neutralized $C_{12-18}$ primary fatty amine. However, as noted in Jansen, the primary fatty acid amines tend to form a precipitate in the presence of anions such as $SO_4^-$, $PO_4^-$ and $CO_3^-$ commonly found as impurities in water which will plug spray nozzles and soil the surfaces of the conveyor system in much the same way as fatty acid soaps in the presence of water hardness. This tendency to precipitate requires implementation of the additional step of periodically rinsing the lubricant application and conveyor system with a detergent such as an organic acid.

Hence, even though primary fatty acid amines were found to provide superior lubricity and antimicrobial activity without formation of a precipitate in the presence of hardness ions, their usefulness was compromised because of their tendency to form a precipitate in the presence of those anions commonly found in water.

Accordingly, a substantial need still exists for a conveyor lubricant which provides a combination of superior lubricity, superior antimicrobial activity and tolerance for both anions and cations commonly found in the water used to dilute the lubricant formulation prior to application to the conveyor system.

SUMMARY OF THE INVENTION

The invention resides in a composition effective as both a lubricant and an antimicrobial agent which is effective with a wide range of water sources having variable concentrations of those anions and cations typically encountered in untreated water and a method for lubricating the load bearing surfaces on a conveyor system using the antimicrobial lubricant composition. The antimicrobial lubricant composition may be formed as a solid or liquid concentrate and includes (i) an effective lubricating and antimicrobial amount of a diamine acetate having the formula $[(R^1)NH(R^2NH_3]^+(CH_3COO)^-$ or $[(R^1)NH_2(R^2)NH_3^{++}](CH_3COO)_2^-$ wherein $R^1$ is a $C_{1-18}$ aliphatic group or an ether group having the formula $R^{10}O(R^{11})$ wherein $R^{10}$ is a $C_{10-18}$ aliphatic group and $R^{11}$ is a $C_{1-5}$ alkyl group; and $R^2$ is a $C_{1-5}$ alkylene group, (ii) an optional amount of an alcohol for the purpose of enhancing the physical stability of the composition, and (iii) an optional amount of a nonionic surfactant effective for assisting in lubrication and cleaning. The liquid form of the lubricant composition includes a major proportion of water while the solid form of the lubricant composition includes an amount of a solidification agent effective for assisting in solidification of the composition. The diamine acetate component of the lubricant composition is preferably formulated by combining the diamine and acetic acid in situ.

The preferred antimicrobial lubricant compositions of the invention combine, in an aqueous medium (i) an effective lubricating and antimicrobial amount of the neutralization product of acetic acid and a diamine having the formula $(R^1)NH(R^2)NH_2$ wherein $R^1$ is a $C_{10-18}$ alkyl group and $R^2$ is a $C_{1-5}$ alkylene group, (ii) an amount of an alcohol for the purpose of enhancing the physical stability of the composition, and (iii) an effective lubricating and cleansing amount of a nonionic surfactant. The antimicrobial lubricant formulations of the invention may also include those additives typically employed such as foam suppressants, viscosity control agents, etc. Chelating agents, such as ethylene diamine tetraacetic acid (EDTA), which are commonly employed in fatty acid based lubricants, need not be employed in the lubricant composition of this invention.

The lubricant formulations of the invention have excellent antimicrobial, cleaning, and lubricity properties and provide a significantly improved combination of friction reduction and anion/cation compatability in comparison to prior antimicrobial lubricants. The lubricant compositions of the invention keep the load bearing surfaces of a conveyor system, including the conveyer chain surfaces, clean and lubricated while simultaneously reducing the population of micro-organisms on the conveyor system, including the chain drive surfaces, to a level effective for preventing slime growth on the system. The lubricant compositions of the invention are also compatable with water sources regardless of anion/cation content and are thereby capable of preventing the formation of a precipitate when the lubricant is diluted with such water without the need for a water softening unit, addition of a chelating agent, and/or a separate cleaning cycle.

DETAILED DESCRIPTION OF THE INVENTION

As utilized herein, including the Examples and Claims, the terms "sanitize" and "sanitizing" are used as defined by the Environmental Protection Agency in the publication "Pesticide Assessment Guidelines" at subdivision G: Product Performance 1982, §91-2(j)2. Accordingly, sanitization occurs only when at least a 3 log reduction is achieved in the number of test micro-organisms in comparison to a parallel control count.

The invention resides in an improved concentrated antimicrobial lubricant composition which may be formulated as a solid or liquid. The antimicrobial lubricant composition comprises (—) an effective lubricating and antimicrobial amount of a diamine acetate having the formula $[(R^1)NH(R^2)NH_3]^+(CH_3COO)^-$ $[(R^1)NH_2(R^2)NH_3{+}{+}](CH_3COO)_2^-$ wherein $R^1$ is a $C_{10-18}$ aliphatic group or an ether group having the formula $R^{10}O(R^{11})$ wherein $R^{10}$ is a $C_{10-18}$ aliphatic group and $R^{11}$ is a $C_{1-5}$ alkyl group; and $R^2$ is a $C_{1-5}$ alkylene group, (—) an amount of an alcohol for the purpose of enhancing the physical stability of the composition, and (—) an effective lubricating and cleansing amount of a nonionic surfactant. The liquid form of the lubricant composition includes a major proportion of water while the solid form of the lubricant composition includes an amount of a solidification agent effective for assisting in solidification of the composition. The composition may also include various optional components intended to enhance lubricity, antimicrobial efficacy, physical and/or chemical stability, etc. The antimicrobial lubricant composition of the invention is particularly well suited for lubricating and controlling microbe populations on the load bearing surfaces and drive chains of conveyor systems, particularly those used in the food processing, brewery and beverage industries.

Diamine Acetate

We have surprisingly discovered that an aqueous solution of selected diamine acetate compounds performs as an effective antimicrobial lubricant composition capable of providing both effective antimicrobial and effective lubricating properties. Useful diamine acetates include those having the formula $$[(R^1)NH(R^2)NH_3]^+(CH_3COO)^-$$

or $$[(R^1)NH_2(R^2)NH_3{+}{+}](CH_3COO)_2^-$$

wherein $R^1$ is a $C_{10-18}$ aliphatic group or an ether group having the formula $R^{10}O(R^{11})$ wherein $R^{10}$ is a $C_{10-18}$ aliphatic group and $R^{11}$ is a $C_{1-5}$ alkyl group; and $R^2$ is a $C_{1-5}$ alkylene group. The preferred diamine acetates are those wherein $R^1$ is a $C_{10-18}$ aliphatic group derived from a fatty acid and $R^2$ is propylene.

Another surprising advantage obtained by the use of diamine acetates is their superior solubility in water sources containing cations/anions compared with both primary amine acetates and fatty acid soaps. Primary amine acetates tend to form insoluble precipitates in the presence of $SO_4^-$, $PO_4^-$ and $CO_3^-$ ions which are commonly found in water sources. Fatty acid soaps tend to form insoluble precipitates in the presence of those cations responsible for the property of water commonly known as hardness. As demonstrated in Tables 2 and 3, diamine acetates provide superior solubility when such anions and/or cations are m present so long as the pH of the solution is less than about 6.0.

Representative examples of useful diamines include N-coco-1,3-propylene diamine, N-oleyl-1,3-propylene diamine, N-tallow-1,3-propylene diamine, and mixtures thereof. Such N-alkyl-1,3-propylene diamines are available from Akzo Chemie America, Armak Chemicals under the trademark Duomeen®.

The diamine acetate may be conveniently produced by reacting a suitable diamine of the formula $(R^1)NH(R^2)NH_2$ with acetic acid under conditions sufficient to produce the diamine acetate. Generally, acetic acid will spontaneously neutralize a diamine to form the diamine acetate under ambient conditions. Preferably the lubricant composition of the invention is formed by (i) mixing together the water, acetic acid, surfactant and alcohol to form a premix, (ii) slowly adding the diamine to the premix under constant agitation to form an intermediate mixture wherein the temperature is maintained well below the boiling temperature of the intermediate mixture, (iii) adding any remaining components including dyes, perfumes, defoamers, etc. after the intermediate mixture becomes clear, and then, (iv) adding the solidification agent. Of course, the solidification agent will be absent when formulating the liquid form and the water will be absent when formulating the solid form.

The mole ratio of acetic acid to diamine should be at least 1:1 to permit substantially complete formation of the monoprotonated salt. Preferably, the mole ratio of acetic acid to diamine is about 2.5:1 to 3:1 to permit substantially complete formation of the diprotonated salt and provide a sufficient excess of acid to maintain the pH of the composition between about 5 and 6.

Nonionic Surfactants

The liquid antimicrobial lubricant compositions of the invention optionally, but preferably, further includes a compatible nonionic surfactant for enhancing the lubricity and cleansing effect of the composition.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include specifically, but not exclusively, ethoxylated alkylphenols, ethoxylated aliphatic alcohols, carboxylic esters, carboxylic amides, and polyoxyalkylene oxide block copolymers.

Particularly suitable nonionic surfactants for use in the antimicrobial lubricant composition of the invention are those having the general formula $$R^5B_nOR^6$$

wherein $R^5$ is a $C_{8-24}$ alkyl, aryl or alkaryl group having a $C_{8-24}$ alkyl portion; B represents an oxyalkylene group having from about 2 to 4 carbon atoms; $R^6$ is hydrogen or a $C_{1-4}$ alkyl or aryl group; and n is a number from 1 to 20 which represents the average number of oxyalkylene groups on the molecule.

Preferred nonionic surfactants of this formula include specifically, but not exclusively, polyalkylene oxide alkoxylates, and ethoxylated alcohols such as octyl ethoxylate, decyl ethoxylate, dodecyl ethoxylate, tetradecyl ethoxylate, and hexadecyl ethoxylate. Based upon their ability to enhance the lubricity and cleansing effect of the antimicrobial lubricant composition at a reasonable cost, a particularly preferred group of nonionic surfactants are nonylphenol ethoxylates (NPE) having about 5 to 10 moles of etheyleneoxide per molecule and $C_{12-18}$ oxo alcohols w/ about 5 to 10 moles of etheyleneoxide per molecule.

Alcohol

The novel antimicrobial lubricant compositions of the invention may also contain a ($C_{1-10}$) alcohol having about 1-5 hydroxy groups for the purpose of enhancing the physical stability of the composition. A nonexhaustive list of suitable alcohols include methanol, ethanol, isopropanol, ethylene glycol, propylene glycol, hexylene glycol, glycerine, low molecular weight polyethylene glycol compounds, and the like.

Water

The liquid antimicrobial lubricant composition of the invention includes a major portion of water in addition to the diamine acetate.

Solidifying Agent

When the lubricant composition of the invention is formulated as a solid the composition must generally include an effective solidifying proportion of a solidifying agent. Any compound which is compatible with the other components of the lubricant composition and is capable of aiding in solidification of the composition may be employed. Suitable solidification agents include higher molecular weight glycols, polyalkylene glycols such as polyethylene glycol (PEG), and urea.

Other Components

In addition to the above mentioned components, the antimicrobial lubricating compositions of the invention may also contain those components conventionally employed in conveyor lubricant compositions, which are compatible in the composition, to achieve specified characteristics such as anti-foam additives, viscosity control agents, perfumes, dyes, corrosion protection agents, etc.

pH

As disclosed in Tables Two and Four, the antimicrobial lubricating composition should produce a diluted use solution having a pH of between about 5 and 7. The ability of the lubricant composition to prevent precipitation in the use solution decreases significantly at use solution pHs of above about 7 while the lubricating efficiency of the use solution decreases rapidly at pHs below about 5. Accordingly, care should be taken to avoid the introduction of too much or too little acetic acid which would tend to produce a pH outside of the desired range. In order to provide optimum performance and overall compatibility with the conveyor system and the packaging material, the antimicrobial lubricating composition preferably provides a diluted use solution with a pH of about 5 to about 6.5.

Concentrations

Broadly, the concentrated liquid antimicrobial lubricant compositions of the invention should include about 1-20 wt. % of the diamine acetate. More specifically, the concentrated liquid composition should be formulated to include about 5-20 wt. % diamine, about 1-20 wt. % acetic acid, about 0-20 wt. % nonionic surfactant, about 0-30 wt. % alcohol, and the balance water, with a mole ratio of acetic acid to diamine of about 1:1 to about 3:1.

Preferred concentrated liquid antimicrobial lubricant compositions of the invention are formulated to include about 5-20 wt. % of one or more N-($C_{10-18}$)alkyl-1,3-propylene diamines, 1-20 wt. % acetic acid, 1-20 wt. % nonionic surfactant, and about 1-30 wt. % hexylene glycol, and the balance water, with a ratio of acetic acid to diamine of about 1:1 to about 3:1.

The concentrated liquid antimicrobial lubricant compositions of the invention are conveniently dispensed by diluting a portion of the composition immediately prior to use with sufficient water to form a use solution which may then be sprayed upon the surface to be lubricated.

The antimicrobial lubricant compositions of the invention may be applied to the load bearing surface of a conveyor system by any of the well recognized methods for such application including the most commonly utilized and widely accepted practice of spraying the lubricant onto the moving conveyor surface. However, prior to dispensing the antimicrobial lubricant compositions of the invention onto the conveyor system, the composition is diluted to use strength. The diluted antimicrobial lubricant use solution should contain about 200 to 4,000 ppm (w/v), preferably about 500 to 2,000 ppm (w/v), diamine acetate.

EXAMPLES

Compositions

Example 1a

For comparison purposes a liquid lubricant employing a primary amine was made by mixing the following ingredients in the order listed below.

| Ingredient | Weight % |
|---|---|
| Water | 65.00 |
| Acetic acid (99%) | 5.00 |
| Propylene glycol | 10.00 |
| Nonyl Phenol Ethoxylate (avg of 9.5 moles EO) | 10.00 |
| Oleyl primary amine | 10.00 |

Example 1b

For comparison purposes a soap based liquid lubricant was made by combining the following components.

| Ingredient | Weight % |
|---|---|
| tetrasodium EDTA | 7.20 |
| phenolic preservation system | unknown |
| coconut oil fatty acids | 10.00 |
| tall oil fatty acids | 10.00 |

Example 2

A liquid antimicrobial lubricant in accordance with this invention was made by mixing the following ingredients in the order listed below.

| Ingredient | Weight % |
|---|---|
| Water | 40.00 |
| Acetic acid (99%) | 10.00 |
| Hexylene glycol | 20.00 |
| Nonyl Phenol Ethoxylate (avg of 9.5 moles EO) | 10.00 |
| Oleyl-1,3-propylene diamine | 15.00 |

-continued

| Ingredient | Weight % |
|---|---|
| Coco-1,3-propylene diamine | 5.00 |

Example 3

A liquid antimicrobial lubricant in accordance with this invention was made by mixing the following ingredients in the order listed below.

| Ingredient | Weight % |
|---|---|
| Water | 43.00 |
| Acetic acid (99%) | 7.00 |
| Hexylene glycol | 20.00 |
| Nonyl Phenol Ethoxylate (avg of 9.5 moles EO) | 10.00 |
| Oleyl-1,3-propylene diamine | 15.00 |
| Coco-1,3-propylene diamine | 5.00 |

Antimicrobial/Lubricity Turbidity Performance

Testing Procedure Antimicrobial Activity

Aqueous lubricant solutions having a 0.5 wt. % concentration of the lubricant compositions of Examples 1-3 were prepared with sterile distilled water. One milliliter of the inoculum, prepared as set froth below, was combined with ninety-nine milliliters of the lubricant solution and swirled for 20 seconds. A one milliliter sample of the lubricant solution/inoculum mixture was removed after a 5 minute exposure time and added to nine milliliters of a sterile neutralizer solution containing asolectin and polysorbate 80 (a polyoxyethylene fatty acid ester). The neutralized sample was serially diluted with buffered water and plated in duplicate using tryptone glucose extract (TGE) agar. The procedure was repeated after fifteen, thirty, and sixty minute exposure times. The plates were incubated at 37° C. for 48 hours.

Controls to determine initial inoculum were prepared by adding one milliliter of inoculum to ninety-nine milliliters of buffered water, serially diluting the mixture with additional buffered water, and plating with TGE.

BACTERIAL INOCULUM:

The bacteria listed below were transferred and maintained on nutrient agar slants. Twenty-four hours prior to testing ten milliliters of nutrient broth was inoculated with a loopful of each organism, one tube per organism. The inoculated nutrient broth cultures were incubated at 37° C. Shortly before testing equal volumes of each incubated broth culture were mixed and used as the test inoculum.

ORGANISMS:

*Pseudomonas aeruqinosa* ATCC 15442
*Staphylococcus aureus* ATCC 6538
*Escherichia coli* ATCC 11229
*Enterobacter aeroqenes* ATCC 13048

Testing Procedure Turbidity

Procedure One

Aqueous lubricant solution samples were created with 0.5 wt. % of each of the lubricant compositions set forth in Table Two with each of the water types listed below. The pH of each sample was adjusted as set forth in Table Two with hydrochloric acid. The turbidity of each sample was then measured with a Hach Model 2100A Turbidimeter and recorded.

Type A:

Deionized water to which has been added 100 ppm each of sodium phosphate, sodium carbonate and sodium sulfate.

Type B:

Soft water containing 17 ppm sulfate ions.

Type C:

Well water containing 15 grains per gallon hardness ions and less than 50 ppm sulfate ions.

Procedure Two

Aqueous lubricant solution samples were created by adding 0.5 wt. % of each of the lubricant composition set forth in Table Three to untreated water samples. The concentration of hardness ions and pH of each sample was measured and recorded. The turbidity of each sample was then measured with a Hach Model 2100A Turbidimeter and recorded.

Testing Procedure Lubricity

A string of six one-liter glass bottles weighing an average of about 1.44 kilograms were placed upon a chain-type conveyor system having a stainless steel load bearing surface and connected to a load cell. The lubricant composition to be tested was diluted with service water to a use concentration of 0.1 wt. % and the pH of the use solution adjusted as desired by adding acetic acid or sodium hydroxide as necessary. The conveyor was operated at full speed (about 120 ft/min), the load bearing surface of the conveyor sprayed with the lubricant use solution at a rate of about 2,000 ml/hr, and the output of the load cell sampled and recorded every second by a computer. Lubricity was measured in terms of the tension generated by the bottles on the load cell.

TABLE One

| | | Antimicrobial Activity | | | | |
|---|---|---|---|---|---|---|
| | | Water Hardness | Log Reduction | | | |
| Trial # | Lubricant | (ppm) | 5 min | 15 min | 30 min | 60 min |
| 1 | Exmple 1a | deionized | >5 | >5 | >5 | >5 |
| 2 | Exmple 1a | 250 | >5 | >5 | >5 | >5 |

TABLE Two

| | | | Turbidity | | |
|---|---|---|---|---|---|
| | | | Turbidity | | |
| Trial # | Lubricant | pH | Type A | Type B | Type C |
| 1 | Exmple 1a | 4 | 175 | 1 | 15 |
| 2 | Exmple 1a | 6 | 190 | 6 | 35 |
| 3 | Exmple 1a | 8 | 210 | 6 | 25 |
| 4 | Exmple 1a | 10 | 80 | 47 | 50 |
| 5 | Exmple 3 | 4 | 14 | 1 | 0 |
| 6 | Exmple 3 | 6 | 55 | 4 | 2 |
| 7 | Exmple 3 | 8 | 58 | 8 | 6 |
| 8 | Exmple 3 | 10 | 28 | 18 | 15 |

TABLE Three

| | | Turbidity | | |
|---|---|---|---|---|
| Trial # | Lubricant | Water Hardness (gpg) | pH | Turbidity |
| 10 | Exmple 1b | 0 | 8.9 | 40 |
| 11 | Exmple 1b | 4 | 8.5 | 100 |
| 12 | Exmple 1b | 5 | 8.6 | 90 |
| 13 | Exmple 1b | 7 | 8.4 | 650 |
| 14 | Exmple 1b | 8 | 8.3 | 260 |
| 15 | Exmple 1b | 8 | 8.4 | 630 |
| 16 | Exmple 1b | 9 | 8.3 | 120 |

TABLE Three-continued

| Trial # | Lubricant | Turbidity Water Hardness (gpg) | pH | Turbidity |
|---|---|---|---|---|
| 17 | Exmple lb | 9 | 8.3 | 130 |
| 18 | Exmple lb | 10 | 8.5 | 850 |
| 19 | Exmple lb | 17 | 8.3 | 860 |
| 20 | Exmple lb | 20 | 8.4 | 650 |
| 21 | Exmple lb | 24 | 8.1 | 700 |
| 22 | Exmple 3 | 0 | 6.3 | 16 |
| 23 | Exmple 3 | 4 | 5.7 | 2 |
| 23 | Exmple 3 | 5 | 5.8 | 3 |
| 25 | Exmple 3 | 7 | 6.0 | 2 |
| 26 | Exmple 3 | 8 | 5.8 | 2 |
| 27 | Exmple 3 | 8 | 6.1 | 8 |
| 28 | Exmple 3 | 9 | 5.5 | 1 |
| 29 | Exmple 3 | 9 | 5.5 | 2 |
| 30 | Exmple 3 | 10 | 6.2 | 2 |
| 31 | Exmple 3 | 17 | 6.2 | 11 |
| 32 | Exmple 3 | 20 | 6.3 | 23 |
| 33 | Exmple 3 | 24 | 6.6 | 58 |

TABLE Four

| Trial # | Lubricant | Lubricity v. pH pH | Tension (grams) |
|---|---|---|---|
| 1 | Exmple 3 | 4 | 2400 |
| 2 | Exmple 3 | 5 | 1000 |
| 3 | Exmple 3 | 6 | 1100 |
| 4 | Exmple 3 | 7 | 1200 |
| 5 | Exmple 3 | 8 | 1200 |
| 6 | Exmple 3 | 9 | 1100 |
| 7 | Exmple 3 | 10 | 1050 |

This description is provided to aid in a complete nonlimiting understanding of the invention. Since many variations of the invention may be made without departing from the spirit and scope of the invention, the breadth of the invention resides in the claims hereinafter appended.

I claim:

1. An antimicrobial conveyor lubricant composition comprising:

(a) an effective lubricating and antimicrobial amount of a diamine acetate having the formula $$((R^1)NH(R^2)NH_3)^+)CH_3COO)^-$$

or $$((R^1)NH_2(R^2)NH_3^{++})(CH_3COO)_2^-$$

wherein $R^1$ is an ether group having the formula $R^{10}O(R^{11})$ wherein $R^{10}$ is an $C_{10-18}$ aliphatic group and $R^{11}$ is a $C_{1-5}$ alkyl group, and $R^2$ is a $C_{1-5}$ alkylene group, (b) an amount of an alcohol effective for enhancing the physical stability of the composition, and (c) a balance of water.

2. The conveyor lubricant of claim 1 wherein the lubricant is in concentrated form and comprises about 1–20 wt. % of the diamine acetate, and about 1–30 wt. % alcohol with the remainder being water, said concentrate forming a functional aqueous antimicrobial conveyor lubricant composition upon dilution with water to a lubricant concentration of about 200 ppm to 4000 ppm.

3. The conveyor lubricant of claim 1 wherein the lubricant comprises about 1–20 wt. % of the diamine acetate.

4. An antimicrobial conveyor lubricant composition comprising:

(a) a major proportion of water, (b) an effective lubricating and antimicrobial amount of a diamine acetate having the formula $$((R^1)NH(R^2)NH_3)^+(CH_3COO)^-$$

or $$((R^1)NH_2(R^2)NH_3^{++})(CH_3COO)_2^-$$

wherein $R^1$ is an ether group having the formula $R^{10}O(R^{11})$ wherein $R^{10}$ is a $C_{10-18}$ aliphatic group and $R^{11}$ is a $C_{1-5}$ alkyl group, and $R^2$ is a $C_{1-5}$ alkylene group, and (c) an effective cleansing amount of a nonionic surfactant.

5. The conveyor lubricant of claim 4 wherein $R^2$ is propylene.

6. The conveyor lubricant of claim 4 wherein the alcohol is hexylene glycol.

7. An antimicrobial conveyor lubricant comprising:

(a) a major proportion of water, (b) an effective lubricating and antimicrobial amount of the neutralization product of acetic acid and a diamine having the formula $$(R^1)NH(R^2)NH_2$$

wherein $R^1$ is an ether group having the formula $R^{10}O(R^{11})$ wherein $R^{10}$ is a $C_{10-18}$ aliphatic group and $R^{11}$ is a $C_{1-5}$ alkyl group, and $R^2$ is a $C_{1-5}$ alkylene group, and (c) an amount of an alcohol effective for enhancing the physical stability of the composition, wherein the pH of the lubricant is between about 5 and 6.

8. The conveyor lubricant of claim 7 wherein the alcohol is hexylene glycol.

9. The conveyor lubricant of claim 7 wherein the lubricant comprises about 1–20 wt. % acetic acid and about 5–20 wt. % diamine.

10. An antimicrobial conveyor lubricant comprising:

(a) an effective lubricating and antimicrobial amount of the neutralization product of acetic acid and a diamine having the formula $$(R^1)NH(R^2)NH_2$$

wherein $R^1$ is an ether group having the formula $R^1OO(R^{11})$ wherein $R^{10}$ is a $C_{10-18}$ aliphatic group and $R^{11}$ is a $C_{1-5}$ alkyl group, and $R^2$ is a $C_{1-5}$ alkylene group, (b) an effective cleansing amount of a nonionic surfactant, and (c) a balance of water wherein the pH of the lubricant is between about 5 and 6.

11. The conveyor lubricant of claim 10 wherein $R^2$ is propylene.

12. The conveyor lubricant of claim 10 wherein the lubricant is in concentrated form and comprises about 1–20 wt. % of the diamine acetate, and about 1–30 wt. % alcohol with the remainder being water, said concentrate and forming a functional aqueous antimicrobial conveyor lubricant composition upon dilution with water to a lubricant concentration of about 200 ppm to 4000 ppm.

13. A process for lubricating and reducing microbiological concentrates on the load bearing surface of a conveyor system comprising the step of coating the load bearing surface of the conveyor system with a conveyor lubricant comprising:

a major proportion of water, and (b) an effective lubricating and antimicrobial amount of a diamine acetate having the formula $$((R^1)NH(R^2)NH_3^+(CH_3COO)^-$$

or $$((R^1)NH_2(R^2)NH_3^{++})(CH_3COO)_2^-$$

wherein $R^1$ is an ether group having the formula $R^{10}O(R^{11})$ wherein $R^{10}$ is a $C_{10-18}$ aliphatic group and $R^{11}$ is a $C_{1-5}$ alkyl group, and $R^2$ is a $C_{1-5}$ alkylene group.

14. A process for lubricating and reducing microbiological concentrations on the load bearing surface of a conveyor system comprising the step of coating the load bearing surface of the conveyor system with a conveyor lubricant comprising:

(a) a major proportion of water, and (b) an effective lubricating and antimicrobial amount of the neutralization product of acetic acid and a diamine having the formula $$(R^1)NH(R^2)NH_2$$

wherein $R^1$ is an ether group having the formula $$R^{10}O(R^{11})$$

wherein $R^{10}$ is a $C_{10-18}$ aliphatic group and $R^{11}$ is a $C_{1-5}$ alkyl group, and $R^2$ is a $C_{1-5}$ alkylene group.

15. A process for lubricating and reducing microbiological concentrations on the load bearing surface of a conveyor system comprising the steps of:

(a) dispersing a concentrate of an antimicrobial an lubricating composition into sufficient water to form an aqueous antimicrobial lubricating solution, wherein (i) said antimicrobial lubricating concentrate comprises at least an effective lubricating and antimicrobial amount of a diamine acetate having the formula $$((R^1)NH(R^2)NH_3)^+(CH_3COO)^-$$

or $$((R^1)NH_2(R^2)NH_3^{++})(CH_3COO)_2^-$$

wherein $R^1$ is an ether group having the formula $$R^{10}O(R^{11})$$

wherein $R^{10}$ is a $C_{10-18}$ aliphatic group and $R^{11}$ is a $C_{1-5}$ alkyl group, and $R^2$ is a $C_{1-5}$ alkylene group, and (ii) said antimicrobial lubricating solution has a pH of between 5 and 6 and comprises at least about 200–4,000 ppm (s/v) of the diamine acetate; and (b) placing said antimicrobial lubricating solution onto the load bearing surface of an operating conveyor system for a period of time effective to lubricate and reduce microbial populations on the load bearing surface.

16. The process of claim 15 wherein the antimicrobial lubricating solution comprises at least about 500–2,000 ppm (w/v) of the diamine acetate.

* * * * *

UNITED STATES PATENT AND TRADEMARK OFFICE

CERTIFICATE OF CORRECTION

PATENT NO. : 5,182,035

DATED : January 26, 1993

INVENTOR(S) : Bruce E. Schmidt and Roger E.F. Swerts

It is certified that error appears in the above-indentified patent and that said Letters Patent is hereby corrected as shown below:

TITLE PAGE

In "[75] Inventors:", "Robert" should read --Roger--.

In column 10, line 50 (claim 10), "R'OO" should read --$R^{10}O$--.

In column 10, line 68 (claim 13), "concentrates" should read --concentrations--.

In column 12, line 4 (claim 15), "an" (2nd occurrence) should read --and--.

In column 12, line 27 (claim 15), "(s/v)" should read --(w/v)--.

Signed and Sealed this

Fourteenth Day of December, 1993

*Attest:*

Bruce Lehman

BRUCE LEHMAN

*Attesting Officer*

*Commissioner of Patents and Trademarks*